US005293668A

United States Patent [19]

Tibiletti

[11] Patent Number: 5,293,668

[45] Date of Patent: Mar. 15, 1994

[54] METHOD FOR MAKING SEALS, IN PARTICULAR FOR GARMENTS, AND SEAL IN ACCORDANCE WITH SAID METHOD

[75] Inventor: Giuseppe Tibiletti, Milan, Italy

[73] Assignee: G.T. S.A.S. Di Giuseppe Tibiletti & C., Baranzate di Bollate, Italy

[21] Appl. No.: 5,183

[22] Filed: Jan. 15, 1993

Related U.S. Application Data

[63] Continuation of Ser. No. 551,949, Jul. 6, 1990, abandoned.

[30] Foreign Application Priority Data

Jul. 14, 1989 [IT] Italy ..... 21194 A/89

[51] Int. Cl.[5] ..... B65D 63/10

[52] U.S. Cl. ..... 24/16 PB; 24/30.5 P; 24/704.1; 206/338

[58] Field of Search ..... 292/320, 325; 206/338, 206/343; 24/16 R, 16 PB, 116 A, 30.5 P, 615, 616, 625, 704.1, 573.1; 264/148, 157, 151, 251, 254

[56] References Cited

U.S. PATENT DOCUMENTS

| | | | |
|---|---|---|---|
| 503,110 | 8/1893 | Denney | 292/320 |
| 570,127 | 10/1896 | Goggle | 292/320 |
| 1,011,440 | 12/1911 | Martineau | 292/320 |
| 1,059,689 | 4/1913 | Webb | 292/320 |
| 2,366,510 | 1/1945 | Frank | 206/343 X |
| 3,273,705 | 9/1966 | Rieger et al. | 206/343 |
| 3,779,589 | 12/1973 | Patterson . | |
| 4,636,347 | 1/1987 | Kato | 264/251 |
| 4,667,378 | 5/1987 | Sturm | 24/616 |

FOREIGN PATENT DOCUMENTS

| | | | |
|---|---|---|---|
| 220160 | 3/1910 | Fed. Rep. of Germany | 292/320 |
| 1591249 | 4/1970 | France . | |
| 2548296 | 1/1985 | France . | |
| 621438 | 6/1961 | Italy | 24/16 PB |
| 1594207 | 7/1981 | United Kingdom | 292/320 |
| 2088468 | 6/1982 | United Kingdom . | |

*Primary Examiner*—James R. Brittain

*Attorney, Agent, or Firm*—Jacobson, Price, Holman & Stern

[57] ABSTRACT

Method for making seals, in particular for garments, in which there are supplied in series at intervals on an unbroken string alternately bodies and graft elements in seats in said bodies to constitute with the string between them a connected plurality of seals separable by cutting the unbroken string.

Said method is used advantageously to realize a separable unbroken series of seals each of which comprises a body and at least one complementary graft element insertable in a seat in the body and connected by a section of string. To achieve this an unbroken string comprises alternately bodies and graft elements formed on itself at regular intervals.

A specific form of embodiment calls for the alternate formation of a body and two graft elements turned in opposite directions so that each separate seal has a body connected by the string to two graft elements therein.

7 Claims, 1 Drawing Sheet

METHOD FOR MAKING SEALS, IN PARTICULAR FOR GARMENTS, AND SEAL IN ACCORDANCE WITH SAID METHOD

This is a continuation of application Ser. No. 07/551,949, filed Jul. 6, 1990, abandoned.

BACKGROUND OF THE INVENTION

Seals (i.e. fasteners) are known, in particular for fixing labels or other to garments, made up of a flexible piece, e.g. a small cord, with clips which can be coupled inseparably at both ends.

Ordinarily said seals are stocked in bunches or bulk and this results easily in tangling of the flexible sections or hooking of the projections of the clips thereto which make the seals difficult to use because the seals must often be untangled in the parts with considerable slowing of the operations of affixing the seals in position.

SUMMARY OF THE INVENTION

The general object of the present invention is to obviate the aforesaid shortcomings and propose a method of making the seals and seals in accordance with the method which would be easy and quick to use without tangling problems. In view of said object it was thought to embody in accordance with the invention a method for making seals, in particular for garments, comprising each a body and at least one graft (i.e. gripper) element insertable in a complementary seat in the body and connected by a section of string or filament and characterized in that it forms in series at intervals on an unbroken string alternately bodies and graft elements to constitute with the string between them a connected plurality of seals separable by cutting the unbroken string.

This method also makes it possible to make a seal, in particular for garments, comprising a body and at least one graft element insertable in a complementary seat in the body and connected by a length of string and characterized in that it comprises bodies and graft elements formed by moulding on the string alternately at regular intervals. In addition it is provided that the string can continue unbroken to connect a plurality of seals separable by cutting.

To make clearer the explanation of the innovative principles of the present invention and its advantages in comparison with the known art there is described below with the help of the annexed drawings a possible embodiment as an example of the application of said principles.

DESCRIPTION OF PREFERRED EMBODIMENTS

One method of embodiment of seals in accordance with the invention consists of fixing in sequence at intervals on an unbroken string the parts making up graft elements of the seal in such a manner as to obtain an unbroken series of seals each made up of complementary graft parts and the length of string separating them.

It is thus advantageously possible to wind said series of seals on a spool or other support and avoid the possibility of tangling as with the seals of the known art and separate one seal at a time upon use, cutting the string at the point of junction between two adjoining seals.

Figure 1:
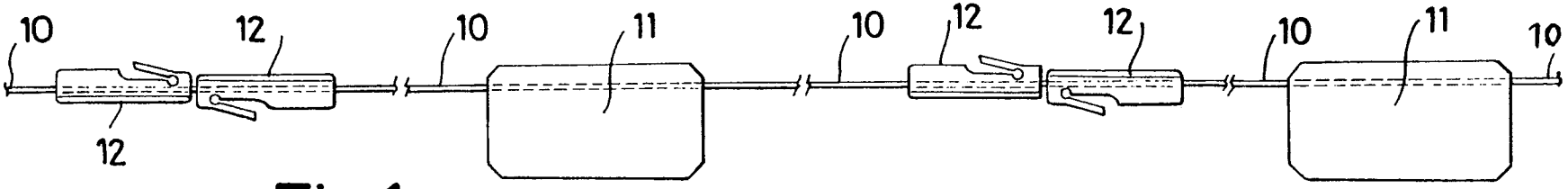
FIG. 1 shows a schematic view of an unbroken plurality of seals made in accordance with the innovative principles claimed herein.

With reference to the figures, in one example of embodiment applying said method as shown in FIG. 1 an unbroken string or filament 10 includes grafts or grippers made up of bodies of female gripper elements 11 and complementary graft elements 12 formed on said string. Each seal i.e. fasteners comprises a body 11 and two grafts 12 connected by the lengths of string between them.

Figure 2:
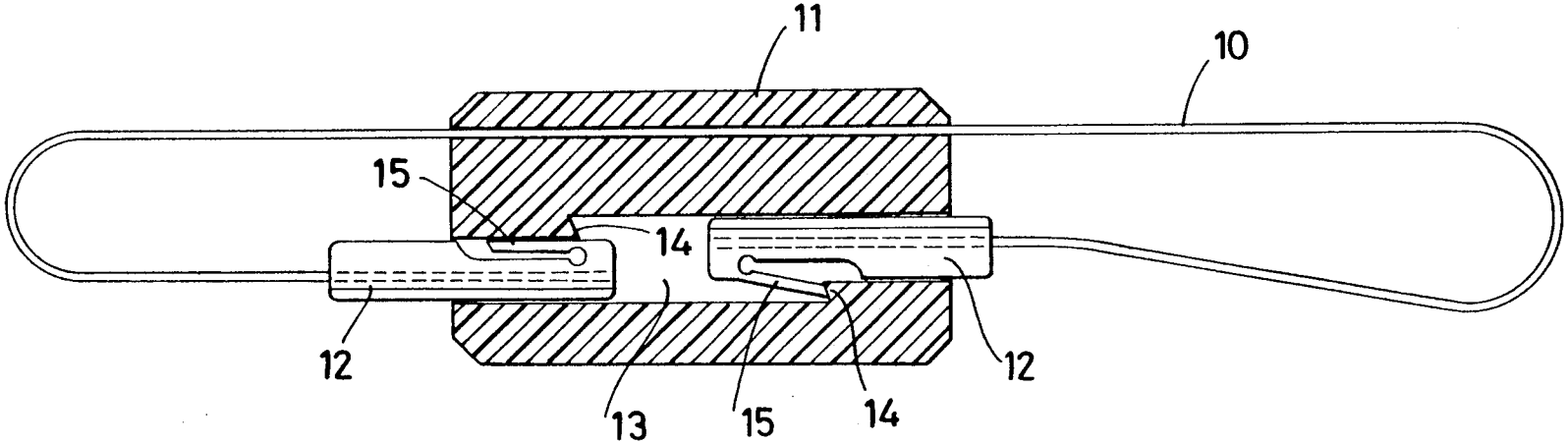
FIG. 2 shows a partial cross-section view of a seal of FIG. 1 separated.

FIG. 2 shows a section of a separated seal with the corresponding grafts 12.

As may be seen in said figure, the body 11 contains internally a seat 13 in the form of a through-bore parallel to filament 10 and shaped with teeth 14 complementary to pliable fins 15 in the grafts 12.

In this manner upon insertion of a graft in the seat 13 the fin 15 is bent against the body of the graft and allows penetration into the body (as with the graft shown on the left in the drawing) until it passes the tooth 14 so as to snap outward (as with the graft shown on the right of the drawing) and prevent subsequent withdrawal. To avoid errors of orientation in insertion of the graft, and thus failure to engage the fin with the respective tooth, its section can be made with a form complementary to the seat in the body 11 and irreversible, i.e. it can be inserted in the seat only in such a manner that the graft fin faces the tooth 14.

Figure 3:
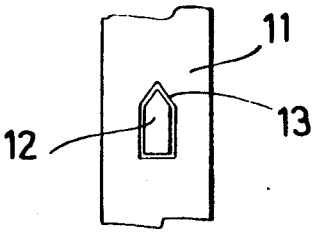
FIG. 3 shows a partial side view of a possible form of graft cross sections of the seal shown in FIG. 2.

To achieve this it is enough that two side walls of the graft be formed asymmetrically as shown for example in FIG. 3.

Advantageously the bodies 11 and grafts 12 of the seals can be moulded directly in plastic on the unbroken string 10.

Each time a seal is needed in use it is enough to unroll a length of string to the first group of elements making up a seal and cut the string between said group and the following one.

In the example of embodiment in the figures this means cutting the length of string between two facing grafts 12. The seal thus separated is made up of a body and the corresponding grafts connected by a length of string and can thus be placed in use by inserting the elements 12 in the body 11 in such a manner that the two lengths of string form closed loops passing through the parts to be connected with the seal, e.g. a button hole of a garment and an explanatory label.

To minimize cord waste it is advantageous to place on the cord the near elements of two successive seals as close as possible while leaving between them only the space necessary for cutting.

From the above description the advantages of the present invention are obvious as it avoids the risk of tangling of the seals before use and makes positioning of said seals fast and easy.

Naturally the description of an embodiment in accordance with the invention is given here as an example and therefore is not to be understood as limiting the scope of the invention claimed.

For example, although in the description each seal comprises a body 11 and two grafts, it is obviously possible to imagine the embodiment of seals with a single graft 12 for each body 11 and then position on the string alternately a body and its graft separated by the distance desired for the length of the seal.

The system of fastening by snapping the grafts into the body of the seal can also be different. For example, it would be possible to embody grafts with two side fins arranged like an arrow for grafting in a corresponding seat of the body.

I claim:

1. An article comprising an elongate filament formed with alternating male and female gripper elements spaced lengthwise along the filament to provide a plurality of fasteners located in series end-to-end along the length of the filament, each fastener including at least one of the male gripper elements, one of the female gripper elements and a length of the filament between the male and female gripper elements, the fasteners being sequentially removable from the article by severing the filament between respective gripper elements, the male gripper element of a fastener being insertable in the female gripper element of the fastener when the fastener is removed from the article and the gripper elements including interlocking formations for precluding subsequent removal of the male gripper element from the female gripper element wherein the male gripper elements are arranged on the filament in pairs between respective female gripper elements with a portion of the filament between the male gripper elements of each pair, the fasteners being formed by serving the filament between the pairs of male gripper elements whereby each fastener comprises a central female gripper element and a pair of male gripper elements each separated from the female gripper element by a length of the filament extending from opposite ends of the female gripper element respectively, the filament extending linearly through each of the gripper elements and the female gripper elements each having opposed openings extending linearly into the element parallel to the filament for receiving the respective male gripper elements.

2. An article as claimed in claim 1 wherein the openings in the female gripper elements are formed by respective through- bores in the female elements, the interlocking formations comprising respective teeth in the through-bores and resilient fins in the respective male elements non-releasably engageable behind the respective teeth.

3. An article as claimed in claim 1 wherein the male and female gripper elements are mutually configured for insertion of the male gripper elements into the female gripper elements in a unique orientation aligning the respective interlocking formations.

4. A method of manufacturing a plurality of fasteners each having a male gripper element and a female gripper element separated by a length of filament, the method comprising forming spaced alternating male and female gripper elements along a filament with the filament extending linearly through each gripper element to provide an article comprising said plurality of fasteners located in series end-to-end along the filament wherein the male gripper elements are provided in pairs on the filament between respective female gripper elements with a portion of the filament between the male gripper elements of each pair and wherein each female gripper element is provided with opposed openings for receiving the respective male gripper elements, said openings extending linearly into the female gripper element parallel to the filament.

5. A method as claimed in claim 4 including the step of severing the filament between a pair of the gripper elements to separate a fastener from the article.

6. A method as claimed in claim 4 which includes the step of separating a fastener from the article by severing the filament between a pair of the male gripper elements.

7. A method as claimed in claim 4 wherein the gripper elements are integrally molded with the filament and said openings in the female gripper elements are formed by through-bores in the female gripper elements.

* * * * *